US006227924B1

(12) United States Patent
Miller

(10) Patent No.: US 6,227,924 B1
(45) Date of Patent: May 8, 2001

(54) SWIM FIN HEEL STRAP

(76) Inventor: Philip W. Miller, 2063 Seeley Rd., Lake Dr., West Harrison, IN (US) 47060

( * ) Notice: Subject to any disclaimer, the term of this patent is extended or adjusted under 35 U.S.C. 154(b) by 0 days.

(21) Appl. No.: 09/519,358

(22) Filed: Mar. 6, 2000

(51) Int. Cl.[7] ..... A63B 31/08
(52) U.S. Cl. ..... 441/64
(58) Field of Search ..... 441/61, 64

(56) References Cited

U.S. PATENT DOCUMENTS

| | | | | |
|---|---|---|---|---|
| D. 151,229 | | 10/1948 | Eddy . | |
| 973,224 | * | 10/1910 | Smith | 441/61 |
| 1,067,612 | * | 7/1913 | Lamb | 441/61 |
| 1,114,466 | * | 10/1914 | Goodenberger | 441/61 |
| 2,672,629 | | 3/1954 | La Trell . | |
| 2,779,077 | | 1/1957 | Kline . | |
| 2,903,719 | * | 9/1959 | Wozencraft | 441/64 |
| 3,239,857 | * | 3/1966 | Gwynne | 441/64 |
| 3,913,158 | | 10/1975 | Vilarrubis . | |
| 3,940,815 | | 3/1976 | Hill . | |
| 4,627,820 | | 12/1986 | Penebre . | |
| 4,795,385 | | 1/1989 | Matsuoka . | |
| 5,083,954 | | 1/1992 | Jacobs . | |
| 5,304,081 | | 4/1994 | Takizawa . | |
| 5,356,323 | | 10/1994 | Evans . | |
| 5,417,599 | | 5/1995 | Evans . | |
| 5,683,279 | | 11/1997 | Raasch et al. . | |
| 5,868,592 | | 2/1999 | Bulin et al. . | |

* cited by examiner

*Primary Examiner*—Stephen Avila
(74) *Attorney, Agent, or Firm*—Charles R. Wilson

(57) ABSTRACT

A heel strap for an open heel swim fin is designed to securely hold the user's foot in the swim fin, yet minimize ankle and foot movement within the heel strap. The heel strap comprises a heel pocket and a set of straps. The heel pocket is shaped to substantially cover the bottom of the heel and to cover all sides of the heel. The straps extend from the heel pocket. They are dimensioned and configured to adjustably attach to the swim fin.

18 Claims, 2 Drawing Sheets

SWIM FIN HEEL STRAP

FIELD OF THE INVENTION

This invention relates to a heel strap for a swim fin. More particularly, the invention relates to an adjustable heel strap for an open heel swim fin which minimizes foot and ankle movement inside the strap for increased comfort and performance while dissipating force pressures on the heel.

BACKGROUND OF THE INVENTION

Swimming has always been an enjoyable water activity for many people. Snorkeling and scuba diving in particular are water activities which are very popular with a small but increasing number of enthusiasts. Swim fins are a necessary part of the equipment needed to fully enjoy the activities. It is a well known fact that swim fins on the swimmer increases the swimmer's water speed and ability to tread water.

Significant developmental effort has been expended on swim fins in recent years. The efforts have evolved into two basic fin styles. One fin style is variously referred to as an open heel or strap fin. It has a propulsion blade portion with a partial foot pocket which fits over a front part of the foot. The fin is held on the foot with a heel strap. The heel strap is adjustable and one fin can be made to fit most sizes of feet. The second fin style is a full foot pocket or shoe fin. It is a one piece integral unit having a propulsion blade portion and a full foot pocket. The foot pocket is sized according to the individual user.

The two fin styles have their advantages and disadvantages. The open heel swim fin is made in three basic sizes. Any adjusting needed to accommodate different size feet is done by the user simply by adjusting the length of the heel strap. It also is very accommodating to protective booties which many swimmers like to wear to protect the feet against abrasions and cold temperatures. However, a secure fit is needed to retain the fin to the foot. Also, the secure fit is needed to prevent a rubbing action of the heel strap onto the foot which likely will result in painful blisters. Over tightening the heel strap is uncomfortable to the user. The conventional heel strap also exerts pressure on the user's achilles tendon which is ultimately felt over time. The bootie which is often worn provides very little protection for the back of the user's ankle against the heel strap pressure. The full foot pocket fin provides a snug secure fin when properly fitted. It is also generally accepted that the full foot pocket fin is capable of delivering more propulsion through the water. However, many sizes must be made and stocked given the many sizes of feet of the users.

As with most products, increasing popularity of swim fin use has resulted in the manufacturers increasing their development efforts to maintain or increase their market share. The propulsion blade portion itself on both styles of swim fins has received considerable attention. It has been contoured and shaped to enhance its water performance. This includes various webbing spaces, water channels and the like. Different materials of construction with varying rigidities and elasticities have also been used to enhance performance.

There also has been some effort expended to make swim fins easier to wear, though such efforts appear to be minimal. In particular, some development work has been done on heel straps which are said to be easier to use and/or more securely hold the fin to the foot. For example, see U.S. Pat. Nos. 5,083,954 and 5,868,592. In accord with a need, an improved heel strap has been developed. The heel strap solves many of the problems associated with known straps, including secure fit, comfort and ankle/foot movement maneuverability.

SUMMARY OF THE INVENTION

A heel strap for an open heel swim fin comprises a heel pocket and a set of straps. The heel pocket substantially covers the bottom of the heel and sides of the heel. Each strap extends from the heel pocket and is adjustable. The straps engage the swim fin to hold the user's foot securely to the swim fin. Foot and ankle movement within the heel strap of the swim fin is minimized by the heel strap of the invention, yet the foot is securely and comfortably held without undue pressure on the heel.

DETAILED DESCRIPTION OF THE INVENTION

The swim fin heel strap of the invention is described in detail in the following paragraphs and with particular reference to the drawings. It should be understood the heel strap is usable with any swim fin having an open foot pocket to receive a forward part of the foot regardless of the swim fin's propulsion blade design. As evident in FIG. 1, the foot of the user is normally covered by a protective bootie, though there are water conditions where the bootie is not required and can be omitted.

Figure 1:
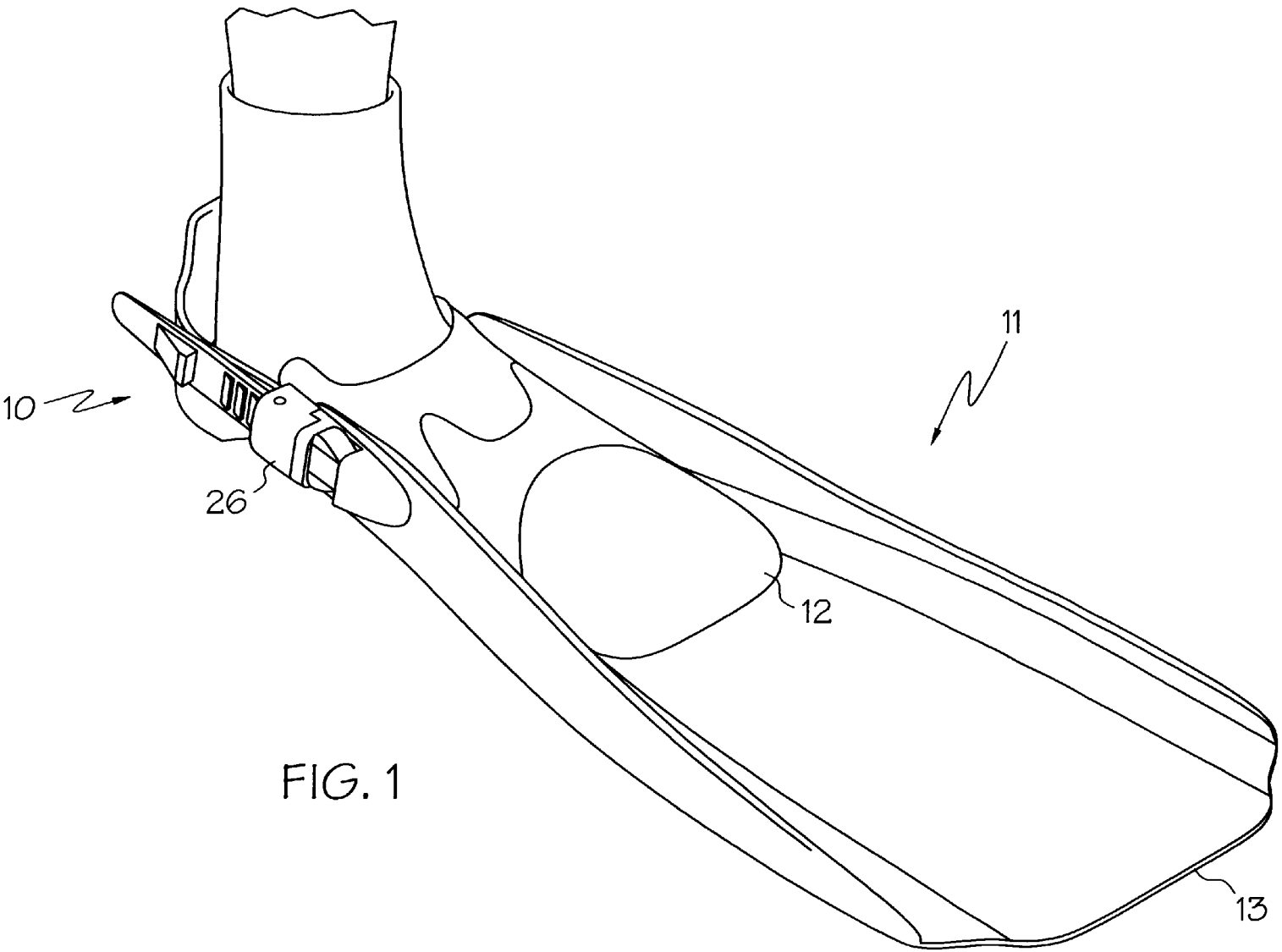
FIG. 1 is an environmental view in perspective of the heel strap of the invention attached to an open heel swim fin and positioned on a user's foot.

With reference to FIG. 1, the heel strap 10 of the invention is attached to an open heel swim fin 11. The swim fin 11 itself is conventional. It has an open-ended partial foot pocket 12 and a flexible propulsion blade 13. The foot pocket has an open end for receiving the foot with an opposed closed toe. The pocket has sufficient depth and width to comfortably receive a foot up to and including the arch of the foot. The propulsion blade extends forwardly of the toe. As shown, the propulsion blade has a central web to create a water channel and semi-rigid raised edges defining the channel. Any of several other propulsion blade designs can as well be used. The partial foot pocket 12 and blade 13 are integral and are made from a synthetic polymeric material conventionally used in the swim fin industry. Examples of suitable materials include thermoplastic elastomers such as synthetic rubber and polyurethane. Preferably, the swim fin is formed by a molding process such as injection molding.

Figure 2:
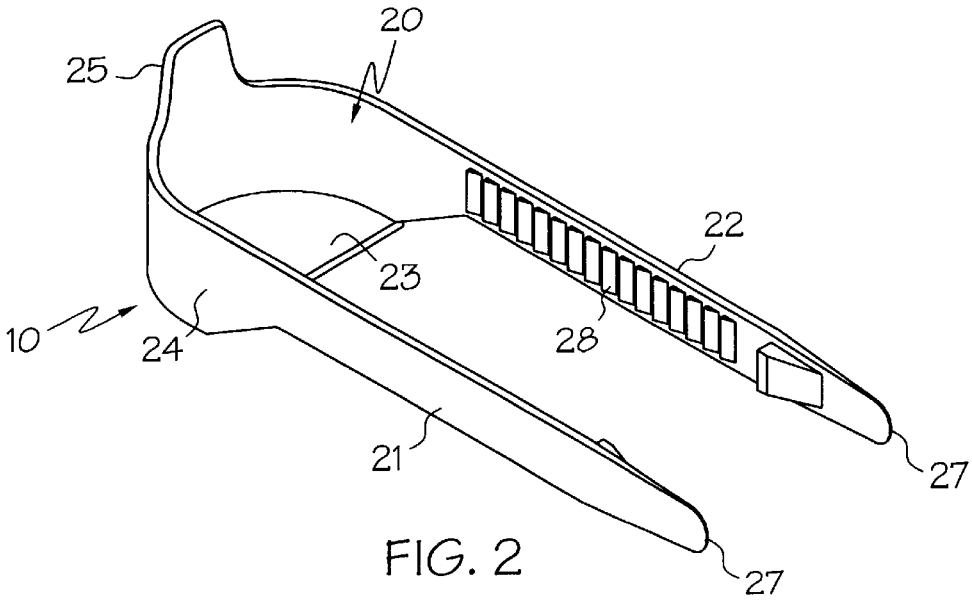
FIG. 2 is a perspective view of the heel strap of FIG. 1 in isolation.
Figure 3:
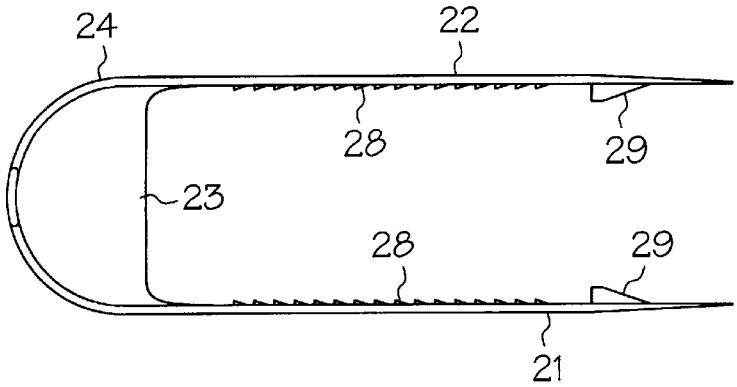
FIG. 3 is a top plan view of the heel strap of FIG. 2.
Figure 4:
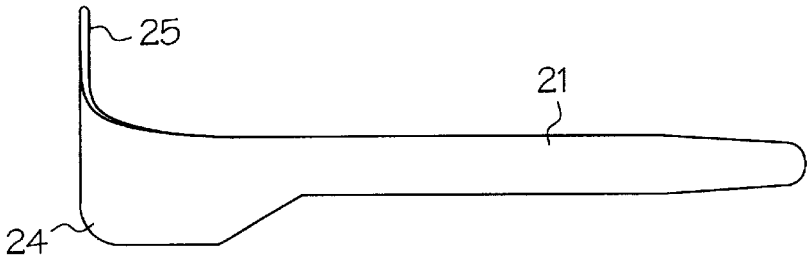
FIG. 4 is a side elevational view of the heel strap of FIG. 2.

As best seen in FIGS. 2–4, the heel strap 10 is a one piece article. It comprises a heel pocket 20, a first strap 21 and a second strap 22. It is molded from a synthetic polymeric material. An elastomer such as a thermoplastic synthetic rubber or polyurethane resin is preferably used to make the heel strap so that a degree of elasticity is present for fitting purposes.

The heel pocket 20 of the heel strap 10 is configured to substantially cover a bottom and all sides of the user's heel. It further is sized to accommodate a bootie worn by the user. It has a substantially flat base wall 23 and an upstanding sidewall 24 which extends on three sides substantially vertically from the base wall 23. The base wall is at least about two inches long, preferably from about two inches to about three inches long. The upstanding sidewall 24 extends at least about one inch from the base wall 23, preferably about one inch to about two inches from the base wall 23.

Preferably, the heel pocket 20 includes a pull tab 25 to aid the user in putting the swim fin onto the foot. The pull tab extends vertically from an approximate back center area of the upstanding sidewall 24. A tab about one inch wide and one inch high is sufficient.

The straps 21 and 22 extend substantially horizontally and forwardly from the heel pocket 20. Each strap is dimensioned to attach to a locking receptacle 26 on the swim fin. With reference to FIGS. 2 and 3, each strap is about three to about six inches long. A terminal end 27 is preferably tapered to aid in its insertion into the locking receptacle 26 on the swim fin. An inside wall of the straps 21 and 22 has a set of substantially vertical ribs 28 which cooperate with the locking receptacle 26 to remain in place once positioned. Retention lugs 29 further aid in threading the strap through the locking receptacle 26. Such straps and locking receptacles are well known and in wide commercial use.

It should be understood the straps 21 and 22 can have other coupling means for adjustable attachment to the swim fin. The couplings means can be a part of the strap itself or the strap can be configured to be received by a coupling means which is secured to the swim fin. For example, a conventional buckle with a cross bar can be secured to the swim fin to receive and securely hold an end of the strap by a wrapping action. Another suitable coupling means is described in Tabata Co. Ltd.'s U.S. Pat. No. 4,795,385, the disclosure of which is hereby incorporated by reference. Still other strap configurations and cooperating locking receptacles can be used as are commercially available. It is also possible for one heel strap to be affixed permanently to the swim fin and the second strap solely used to adjustably hold the swim fin to the user's foot.

In use, the straps of the heel strap are coupled to the swim fin to allow ample space for the user to slip his or her foot into the swim fin's partial foot pocket. Once the foot is comfortably positioned in the foot pocket, the user simply tightens the heel strap for a snug fit. Depending on the elasticity of the particular heel strap, it is also possible to stretch out the straps a sufficient distance and then insert the foot into the foot pocket of the swim fin. When the force is removed, the heel strap holds the foot in the fin without further adjustment. Removing the swim fin from the foot is accomplished simply by reversing the above procedure.

When properly worn, the heel strap covers the bottom of the user's heel and extends upwardly on the back and sides of the heel. Movement of the foot and ankle in the swim fin, which can cause blisters, is essentially eliminated. This lack of unwanted movement also enhances performance of the swim fin. The secure but snug fit results in part due to the large surface area of the upstanding sidewall of the heel pocket. In effect, pressure from the heel strap is spread over a large part of the heel to dissipate contact forces on the user's heel and tendons to result in a secure, but comfortable fit. Very important is the fact the heel strap of the invention transfers the pressure to the user's heel bottom and back which are relatively tough and further are covered by a tough part of the protective bootie, i.e. its thick sole area. The user's ankle back which itself is rather susceptible to injury and which is only covered by a thin walled part of the bootie receives very little pressure from the heel strap.

As should be evident, the heel strap cannot ride up on the user's ankle because of the heel pocket's base wall. The heel strap's interaction with buckling typically included on the protective bootie also ensures the swim fin will not slip off the user's foot as well.

The heel strap of the invention can be modified to enhance its appearance and performance without sacrificing the aforediscussed benefits. For example, the heel strap can be colored or have embossings of various designs. Elongated ribs can be molded into the outer surface of the heel pocket and/or straps for a more stylistic visual impact and possibly to strengthen the heel strap. The base wall of the heel pocket can also be lengthened so that it extends into the open heel partial foot pocket of the swim fin when properly worn. Further, the lengthened base wall is sufficiently rigid so that a more efficient connection is created between the user's foot and the swim fin.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

What is claimed is:

1. A heel strap for attaching to a swim fin to hold a foot of the user to the swim fin in a secure comfortable manner which minimizes pressure on the user's heel and tendons, said heel strap comprising a heel pocket having a substantially flat base wall and an upstanding sidewall which extends from the base wall for substantially covering a bottom and all sides of the heel and a set of straps attached to the heel pocket, each said strap extending forwardly from the heel pocket for engagement with the swim fin whereby the heel pocket of the heel strap prevents the straps from riding up onto an ankle of the user and further minimizes foot and ankle movement of the user by substantially encompassing the heel and dissipating force pressures on the heel.

2. The heel strap of claim 1 further wherein the heel pocket has a pull tab extending from the upstanding sidewall.

3. The heel strap of claim 1 wherein the substantially flat base wall of the heel pocket is configured to cover the full bottom of the user's heel.

4. The heel strap of claim 1 wherein each of the straps has a means to releasably attach to the swim fin.

5. The heel strap of claim 4 wherein each strap has a set of spaced substantially vertical ribs to engage a locking receptacle at a selected distance along the straps.

6. The heel strap of claim 1 further wherein the upstanding sidewall of the heel pocket extends at least about one inch from the substantially flat base wall.

7. The heel strap of claim 1 wherein the heel pocket is configured to fully cover the user's heel up to an arch and up to an ankle when worn.

8. The heel strap of claim 1 wherein the heel pocket and the straps are integral.

9. The heel strap of claim 8 wherein the heel pocket and straps are molded from a thermoplastic elastomer.

10. A one piece molded heel strap of an elastomeric material for attaching to an open heel swim fin to hold a foot of the user to the swim fin in a secure comfortable manner which minimizes pressure on the user's heel and tendons, said heel strap comprising a heel pocket having a substantially flat base wall and an upstanding sidewall which extends substantially vertically from the base wall for covering a bottom side, back side and both sides of the user's heel and a first strap attached to the heel pocket and a second strap attached to the heel pocket, each said first strap and second strap extending substantially horizontally and forwardly from the heel pocket for engagement with the swim fin whereby the heel pocket of the heel strap prevents the straps from riding up onto an ankle of the user and further minimizes foot and ankle movement of the user by substantially encompassing the heel and dissipating force pressures on the heel.

11. The heel strap of claim 10 wherein the substantially flat base wall of the heel pocket is configured to cover the full bottom of the user's heel.

12. The heel strap of claim 11 wherein each of the first and second straps has a means to releasably attach to the swim fin.

13. The heel strap of claim 12 wherein the upstanding sidewall of the heel pocket extends at least about one inch from the substantially flat base wall.

14. The heel strap of claim 13 further wherein the heel pocket has a pull tab extending from the upstanding sidewall.

15. A heel strap for attaching to an open heel swim fin to hold a foot of the user to the swim fin in a secure comfortable manner which minimizes pressure on the user's heel and tendons, said heel strap comprising (a) a heel pocket having a substantially flat base wall configured to cover a full bottom of the user's heel and having an upstanding sidewall which extends at least about one inch from the base wall and further said upstanding sidewall has a pull tab extending therefrom, said heel pocket for covering a bottom side, back side and both sides of the user's heel and (b) a first strap attached to the heel pocket and a second strap attached to the heel pocket, each said first strap and second strap extending from the heel pocket and each of said first strap and second strap having a means for releasably attaching to the swim fin whereby the heel pocket of the heel strap prevents the straps from riding up onto an ankle of the user and further minimizes foot and ankle movement of the user by substantially encompassing the heel and dissipating force pressures on the heel.

16. The heel strap of claim 15 wherein the heel pocket and the straps are integral.

17. The heel strap of claim 16 wherein the heel pocket and straps are molded from a thermoplastic elastomer.

18. The heel strap of claim 15 wherein the first strap and the second strap each has a set of spaced substantially vertical ribs for engaging a locking receptacle of the open heel swim fin at a selected distance along said first strap and said second strap.

* * * * *